US007593669B2

(12) United States Patent
Shigehiro

(10) Patent No.: US 7,593,669 B2
(45) Date of Patent: Sep. 22, 2009

(54) IMAGE FORMING APPARATUS

(75) Inventor: Koji Shigehiro, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 228 days.

(21) Appl. No.: 11/854,924

(22) Filed: Sep. 13, 2007

(65) Prior Publication Data

US 2008/0069590 A1 Mar. 20, 2008

(30) Foreign Application Priority Data

Sep. 20, 2006 (JP) ..... 2006-255070

(51) Int. Cl.
*G03G 15/00* (2006.01)
*G03G 15/08* (2006.01)

(52) U.S. Cl. ..... 399/149; 399/71; 399/148; 399/150; 399/53; 399/129

(58) Field of Classification Search ..... 399/71, 399/130, 148–150, 53, 55, 128, 129
See application file for complete search history.

(56) References Cited

U.S. PATENT DOCUMENTS 5,797,070 A 8/1998 Waki et al.
2006/0067742 A1* 3/2006 Hattori et al. ..... 399/283

FOREIGN PATENT DOCUMENTS

JP 9-146334 A 6/1997
JP 2004-252180 A 9/2004

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image forming apparatus includes an exposure device for exposing an electrically charged surface of an image bearing member to light to form an electrostatic image; a developing device capable of collecting a transfer residual developer remaining on the image bearing member; a transferring device for transferring a developer image from the image bearing member onto a transfer medium at a transfer position; and a controller for executing, during non-image formation, a developer collecting mode in which a developer of an opposite polarity is collected into the developing device by driving the image bearing member and by causing the developer carrying member to stop its rotation or rotate at a speed slower than a rotational speed thereof during image formation while generating a potential difference capable of transferring the developer of the opposite polarity from the image bearing member onto the developer carrying member.

8 Claims, 10 Drawing Sheets

(a)

○ REVERSE TONER COLLECTING BIAS (b)

○ POTENTIAL DURING SOLID IMAGE FORMATION

IMAGE FORMING APPARATUS

FIELD OF THE INVENTION AND RELATED ART

The present invention relates to a cleanerless-type image forming apparatus using electrophotography. More specifically, the present invention relates to a cleanerless-type image forming apparatus in which a developer (toner) remaining on an image bearing member after a transferring process is removed from the image bearing member and collected by a developing device to be used again and thus a cleaning device is not necessitated.

An embodiment of a conventional image forming apparatus using electrophotography is shown in FIG. 11. As shown in FIG. 11, an image forming apparatus 100 electrically charges uniformly a surface of a photosensitive member 1 ordinarily having a drum shape as an image bearing member by a charging device 2. Then, the charged photosensitive member 1 is exposed to light depending on image information by an exposure device 3 to form an electrostatic latent image on the photosensitive member 1.

The electrostatic latent image formed on the photosensitive member 1 is visualized or developed with a developer by a developing device 4 provided with a developer carrying member 41 to provide a developer image (i.e., a toner image). The toner image is transferred onto a recording medium S by a transferring device 5. Thereafter, the toner image transferred onto the recording medium S is melt-fixed on the recording medium S under application of heat and pressure by a fixing device 6. Toner remaining on the photosensitive member 1 after the transferring process is removed by a cleaning device 7 provided with a cleaning blade 71 or the like, and electric charges remaining on the photosensitive member 1 are removed by a discharging device 8. The photosensitive member 1 prepares for a subsequent image forming process.

Generally, the transfer residual toner removed from the surface of the photosensitive member 1 by the cleaning device 7 is contained or accommodated in a waste toner collecting container (not shown) provided and connected to the cleaning device 7. In order to provide an image forming apparatus having a long durable lifetime, this contained is required to be increased in size, thus being disadvantageous in terms of downsizing of the image forming apparatus.

In view of this disadvantage, there is provided a cleanerless-type image forming apparatus in which the cleaning device 7 having the waste toner collecting container is not necessitated and the transfer residual toner on the photosensitive member 1 after the transferring process is removed and collected for reuse from the photosensitive member 1 by "simultaneous development and cleaning" by means of the developing device 4.

In the "simultaneous development and cleaning", the transfer residual toner on the photosensitive member 1 after the transferring process is collected during a developing process in a subsequent process or later. More specifically, in the subsequent process, the photosensitive member 1 is electrically charged and exposed to light to form an electrostatic latent image. Thereafter, in a developing process for developing this electrostatic latent image, the transfer residual toner present at a portion (un-exposed portion or a non-image portion) where the electrostatic latent image should not be developed is collected in the developing device 4 by a fog-removing bias. The fog-removing bias means a potential difference Vback between a developing bias generated by applying a DC voltage to the developer carrying member 41 and a surface potential at the non-image portion on the photosensitive member 1.

According to the simultaneous development and cleaning method, the transfer residual toner is collected in the developing device 4 and used again for developing an electrostatic latent image in a subsequent process or later. For this reason, waste toner is not produced and it is also possible to reduce maintenance requirement, so that absence of a waste toner container is also advantageous in terms of downsizing of the image forming apparatus.

The above described cleanerless-type image forming apparatus can be well achieved by using, as a developer, spherical toner produced through a polymerization method. The reason why a toner reuse process by the cleanerless process or the simultaneous development and cleaning can be achieved by the spherical toner produced through the polymerization method will be described below by focusing attention on an adhesive force between the toner and the photosensitive member 1.

When the toner is deposited on the photosensitive member 1 by a developing bias or a latent image potential in the developing process, a principal force acting on the toner contacting the surface of the photosensitive member 1 includes mirror force and Van der Waals force.

The mirror force largely depends on an amount of electric charges and a distance from the electric charges. Pulverized toner produced by a conventional pulverization method has recesses and projections at surfaces of toner particles, so that the projections are concentratedly charged by triboelectric charge. In contrast, polymerized toner produced by a polymerization method has a spherical or near-spherical surface shape, so that the surfaces of toner particles are electrically charged uniformly. In the pulverized toner, the projections of the toner particles contact each other, so that a large amount of electric charges are present in a close area. For this reason, a resultant mirror force increases. However, when the toner particles have the spherical shape as in the case of the polymerized toner, a contact state of the toner particles is an almost point contact state and the toner particles are uniformly charged at their surfaces. Accordingly, an amount of the electric charges in the close area is small, so that a resultant mirror force is smaller than that in the case of the pulverized toner.

Further, in the case of using the pulverized toner, in most of the toner particles, a large number of toner particles contacting each other at their surface projections as described above are present, so that the Van der Waals force has an influence on the toner particles in the closest area and is considerably increased in a planar contact state of the toner particles. For this reason, in the case of using the pulverized toner, the Van der Waals force is very large. In contrast, the polymerized toner has the spherical surface shape, so that the toner particles are almost brought in point contact with each other. Therefore, the Van der Waals force of the polymerized toner is also smaller than that of the pulverized toner.

For the reasons described above, in the case of the near-spherical polymerized toner, the adhesive force (mirror force, Van der Waals force) with respect to the photosensitive member 1 is decreased. As a result, an amount of the transfer residual toner by the transferring process is decreased and a toner collecting effect during the simultaneous development and cleaning is enhanced, so that it is possible to realize the cleanerless process and the simultaneous development and cleaning.

For example, an embodiment of a cleanerless-type image forming apparatus, as described in Japanese Laid-Open Patent Application (JP-A) Hei 9-146334, in which transfer residual toner on a photosensitive member 1 after a transferring process is removed and collected for reuse by simultaneous development and cleaning in a developing device 4 and in which an intermediary transfer member 51 is provided will be described with reference to FIG. 2.

In this embodiment, a charging device 2 for the photosensitive member 1 is a contact charging device for electrically charging a surface of the photosensitive member 1 in contact with the photosensitive member 1. In this case, when the transfer residual toner on the photosensitive member 1 passes through a charging portion which is a nip between the photosensitive member 1 and the contact charging device 2, of the transfer residual toner, toner particularly charged to a polarity opposite to a normal charge polarity, i.e., reversely charged toner is deposited on the contact charging device 2. As a result, the contact charging device 2 is contaminated with the toner at a level exceeding allowable level.

Further, the reversely charged toner remaining on the photosensitive member 1 without being collected by the contact charging device 2 contaminates the photosensitive member 1. The toner deposited on the photosensitive member 1 and the toner deposited on the contact charging device 2 are fused by a contact force between the contact charging device 2 and the photosensitive member 1 to cause contamination such as filming or the like. The filming is a phenomenon that fused toner is firmly deposited. These phenomena cause improper charging to lead to lifetime shortening and a lowering in image quality.

More specifically, the toner as the developer mixedly includes the reversely charged toner originally having the opposite polarity to the normal charge polarity although an amount of the reversely charged toner is small. Further, even toner having the normal charge polarity can include a component reversed in charge polarity by the influence of a transfer bias or a component decreased in charge amount by charge removal.

Accordingly, the transfer residual toner mixedly includes the reversely charged toner, the normally but less charged toner, and the normally charged toner. Of these components, the reversely charged toner and the less charged toner are particularly liable to deposited on the photosensitive member 1 and the contact charging device 2 by a non-electrostatic force when they pass through the charging nip (charging portion) T. For this reason, in order to remove and collect the transfer residual toner from the photosensitive member 1 by the simultaneous development and cleaning by means of the developing device 4, the following is important.

That is, it is necessary that the charge polarity of the transfer residual toner on the photosensitive member 1 passed through the charging portion and carried to a developing portion is the normal polarity and that the charge amount of the transfer residual toner is an amount capable of development of the electrostatic latent image on the photosensitive member 1. The reversely charged toner and the toner having an improper charge amount are not readily removed or eliminated from the photosensitive member 1 to the developing device 4, thus causing contamination of the photosensitive member 1 and the contact charging device 2 and a defective image.

The reversely charged toner can be removed and collected from the photosensitive member 1 only by collecting the reversely charged toner in the developing device 4 by a contrast potential (Vcont) in an image forming area of the photosensitive member 1 or by returning the charge polarity of the reversely charged toner to the original normal polarity by a brush-like auxiliary charging device 8. The contrast potential (Vcont) in the image forming area is a potential difference between a surface potential at an image portion on the photosensitive member and a potential of the developer carrying member. The reversely charged toner is the toner having the opposite polarity (to the normal polarity), so that the reversely charged toner can be transferred from the photosensitive member onto the developer carrying member when a potential difference capable of transfer of the normal-polarity toner from the developer carrying member onto the photosensitive member is provided between the photosensitive member and the developer carrying member. Therefore, e.g., when the above described Vcont is set as shown in FIG. 6(*b*), the reversely charged toner on the photosensitive member can be collected by the developer carrying member. In this case, however, simultaneously with the collection of the reversely charged toner, the transfer of the normal-polarity toner onto the photosensitive member is also caused to occur. When the reversely charged toner is collected, it is difficult to collect all the reversely charged toner scattered on the photosensitive member 1 unless an image covering an entire image forming or an image close thereto is formed. When an entire solid image is formed, a large amount of the toner electrically charged to the normal polarity is required to be consumed, so that a large amount of waste toner is generated.

Further, the auxiliary charging device 8 which collects the carried toner and electrically charges the collected toner again to the normal polarity shows a tendency to decrease an amount of current passing through the auxiliary charging device 8 with an increasing number of successively printed sheets leading to an increase in amount of the toner and external additive held by the auxiliary charging device 8. For this reason, it is difficult to return the charge polarity of all the reversely charged toner to the normal polarity in the case where the number of successively printed sheets is increased or in the case where a large amount of the transfer residual toner passes through the auxiliary charging device 8 at one time.

Further, as another method of removing the reversely charged toner from the photosensitive member 1, as disclosed in JP-A 2004-252180, there is a method in which reversely charged toner is transferred onto an intermediary transfer member by applying a bias of an opposite polarity to that during ordinary image formation at a primary transfer portion N1 and is collected by an intermediary transfer member cleaner. However, this method is not preferable from viewpoints of cost regarding means for applying the reverse bias and disposal of the reversely charged toner without being collected.

SUMMARY OF THE INVENTION

A principal object of the present invention is to provide an image forming apparatus capable of efficiently collecting a developer of an opposite polarity deposited on an image bearing member.

According to an aspect of the present invention, there is provided an image forming apparatus comprising:

a charging device for electrically charging a surface of an image bearing member;

an exposure device for exposing the surface of the image bearing member to light to form an electrostatic image;

a developing device, comprising a rotatable developer carrying member for carrying a developer, for developing the electrostatic image on the image bearing member into a developer image;

a transferring device for transferring the developer image from the image bearing member onto a transfer medium at a transfer position;

wherein the developing device is capable of collecting a developer remaining on the image bearing member without being transferred during the transfer, and a controller for executing, during non-image formation, a developer collecting mode in which a developer of a polarity opposite to a normal polarity remaining on the image bearing member is collected into the developing device by driving the image bearing member and by causing the developer carrying member to stop its rotation or rotate at a speed slower than a rotational speed thereof during image formation while generating a potential difference, between the image bearing member and the developer carrying member, capable of transferring the developer of the polarity opposite to the normal polarity from the image bearing member onto the developer carrying member.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Hereinbelow, the image forming apparatus according to the present invention will be described more specifically with reference to the drawings.

Embodiment 1

[General Constitution of Image Forming Apparatus]

First, a general constitution and operation of an image forming apparatus of this embodiment will be described. In this embodiment, the image forming apparatus employs an intermediary transfer method and a simultaneous development and cleaning method and a general constitution of the image forming apparatus is shown in FIG. 1.

Figure 1:
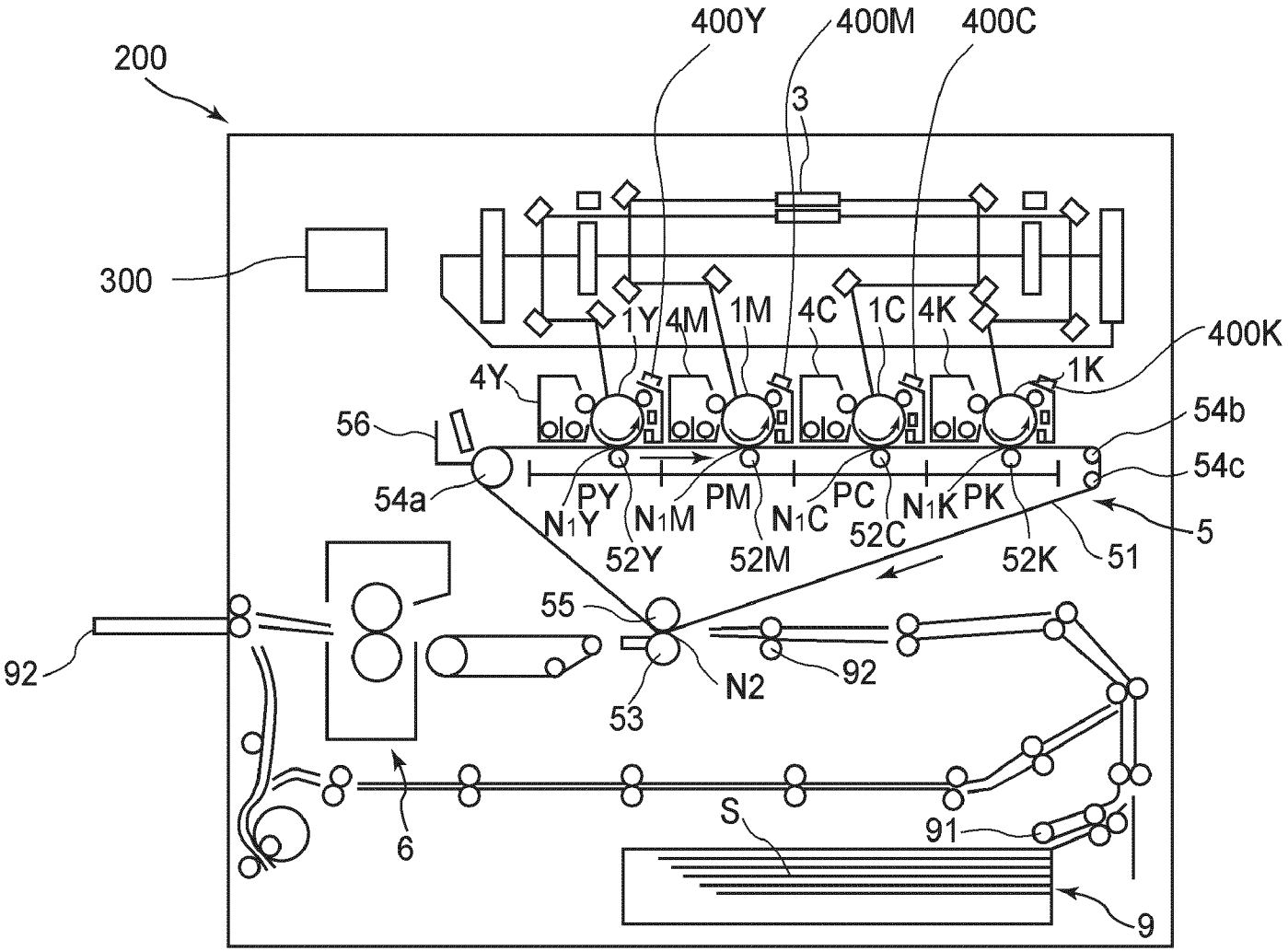
FIG. 1 is a schematic constitutional view of an embodiment of an electrophotographic image forming apparatus according to the present invention.

Referring to FIG. 1, an image forming apparatus 200 is a train-of-four tandem-type image forming apparatus and includes a plurality of image forming portions (or stations) P. These image forming portions P are constituted by first to fourth image forming stations P (PY, PM, PC and PK) for forming images of yellow, magenta, cyan, and black, respectively. In this embodiment, during passage of an intermediary transfer member 51 constituting a transferring device 5 through the respective image forming stations P while being moved in a direction of an indicated arrow, respective color images are superposed on the intermediary transfer member 51 at the respective image forming stations P. These multiple toner images superposed on the intermediary transfer member 51 are transferred onto a recording material S such as a transfer sheet as a recording medium. The intermediary transfer member and the recording medium are herein inclusively referred to as a transfer medium.

In this embodiment, constitutions of the respective image forming stations P are substantially identical to each other except that development colors are different from each other. Accordingly, in the case where a particular distinction among the stations P is not required, suffixes Y, M, C and K added for identifying the image forming stations P are omitted and the image forming stations P are collectively described. Further, the respective image forming stations P (PY, PM, PC and PK) have the same constitution as those described above with reference to FIG. 2.

More specifically, referring to FIGS. 1 and 2, as an image bearing member in this embodiment, the image forming station P includes a cylindrical image bearing member 1 comprising an organic photoconductor (OPC) having a negatively chargeable surface layer (hereinafter, referred to as a "photosensitive drum"). The photosensitive drum 1 is rotationally driven in an indicated arrow direction. A charging device 2 as a charging means is provided in contact with the photosensitive member 1. In this embodiment, the charging device 2 includes a charging roller 2 as a contact charging device and electrically charges the photosensitive drum 1 by applying a charging bias voltage to the charging roller 2. An exposure device 3 as an exposure means is disposed downstream from the charging device 2 with respect to the rotational direction of the photosensitive member 1 and exposes the surface of the photosensitive drum 1 to light to form an electrostatic image. In this embodiment, the exposure device 3 is a laser scanning exposure optical system including a laser light source, a polygon mirror, etc.

A developing device 4 is provided further downstream from an exposure position of the photosensitive drum 1 so as to be adjacent to the photosensitive drum 1. In this embodiment, the developing device 4 employs, as a developer, a two-component developer principally containing resinous toner particles (toner) and magnetic carrier particles (carrier). The developer is carried on a roller-type developer carrying member (developing sleeve) 41 containing therein a magnet and regulated by a developing blade 42 as a developer layer thickness regulation member to be conveyed to the photosensitive drum 1. More specifically, a magnetic brush with the developer is formed on the developing sleeve 41 and brought into contact with the surface of the photosensitive drum 1. Simultaneously, a developing bias voltage is applied from a power source S4 to the developing sleeve 41 to create an electric field between the developing sleeve 41 and the photosensitive drum 1, whereby toner in the magnetic brush is transferred onto the photosensitive drum 1 depending on the electrostatic image to form a development image, i.e., a transfer image.

In this embodiment, reverse development is effected by using negatively chargeable toner. The reverse development is developing method in which a latent image is formed by performing image signal-dependent light exposure with respect to the photosensitive member surface negatively charged uniformly to lower a potential and is then developed with the negatively chargeable toner. A toner hopper (toner supply means) 43 supplies the toner in a necessary amount to the developing device 4 via a transfer buffer 44 on an as needed basis.

An intermediary transfer belt 51 as the intermediary transfer member charging a transferring device 5 is stretched around stretching rollers 54 (54*a*, 54*b*, 54*c*) and a backup roller 55 and moved (rotationally driven) in an indicated arrow direction in contact with the photosensitive drum 1. The intermediary transfer belt 51 is interposed between the photosensitive drum 1 and a primary transfer roller 52 as a primary transfer means, so that a primary transfer nip (primary transfer portion) N1 (N1Y, N1M, N1C, N1K) is created between the photosensitive drum 1 and the intermediary transfer belt 51. A secondary transfer roller 53 as a secondary transfer means is disposed opposite to the backup roller 55 via the intermediary transfer belt 51 and forms a secondary transfer nip (secondary transfer portion) N2 between it and the intermediary transfer belt 51.

The image forming apparatus 200 includes, as a supplying means of the recording material S, a cassette 9 containing the recording material S and registration rollers 92 for supplying the recording material S fed and conveyed from the cassette 9 by a feeding and conveying roller 91 and the like to the secondary transfer nip N2. In the conveying direction of the recording material S, a fixing device 6 is disposed downstream from the secondary transfer nip N2. Further, an intermediary transfer member cleaner 56 is provided downstream from the secondary transfer nip N2 with respect to a movement direction of the intermediary transfer belt 51.

Figure 2:
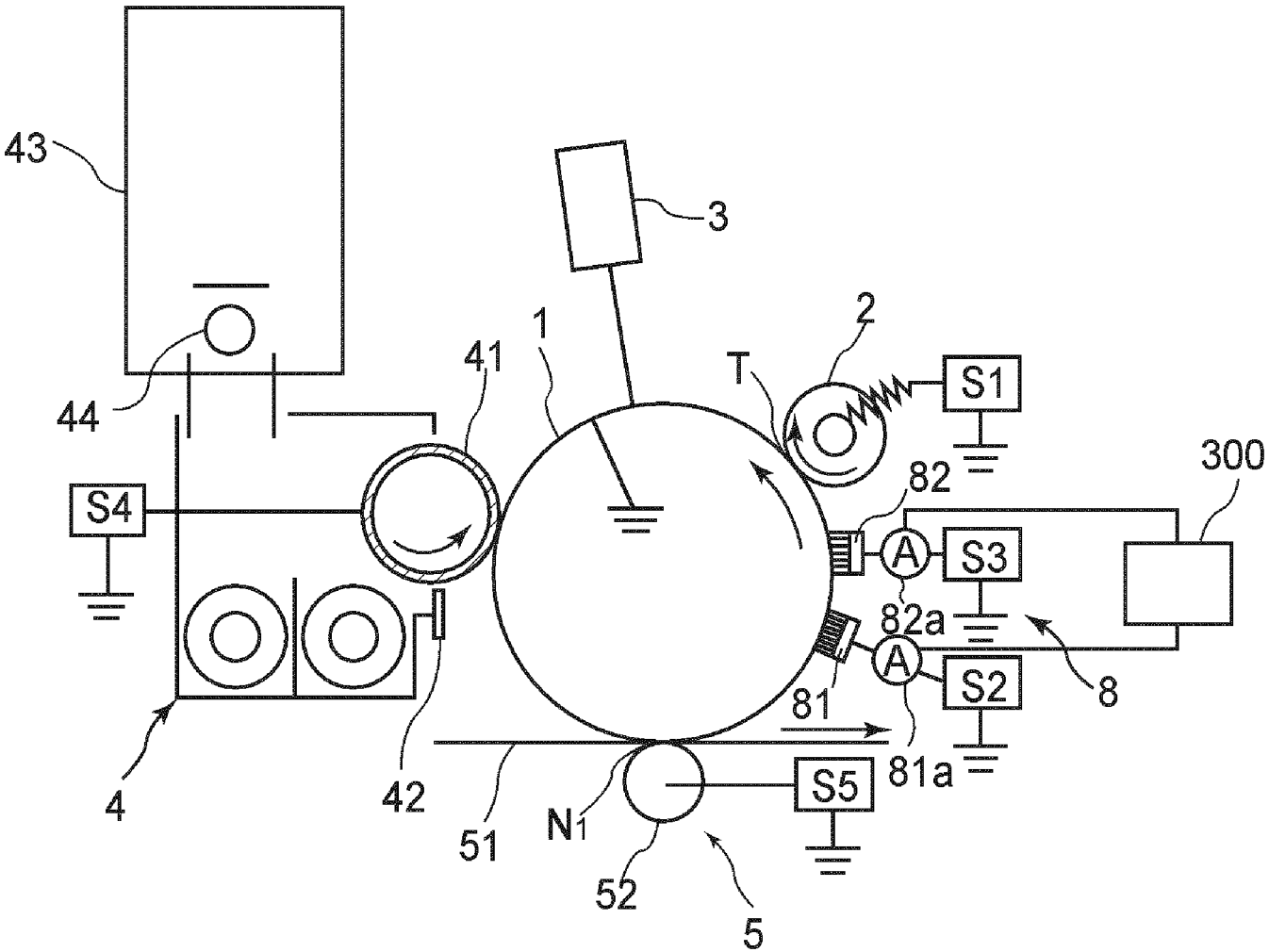
FIG. 2 is a schematic sectional view showing details of an image forming portion of an image forming apparatus.

In this embodiment, as shown in FIG. 2, at a position downstream from the primary transfer portion N1 with respect to the rotational direction of the photosensitive drum 1, a brush-like residual developer uniformizing means (upstream auxiliary charging means) 81 for uniformizing a charge amount of the transfer residual toner on the photosensitive drum 1 is provided as an auxiliary charging device 8. Further, at a position downstream from the upper auxiliary charging means 81 and upstream from the charging roller 2 with respect to the rotational direction of the photosensitive drum 1, a residual developer charge amount control means (downstream auxiliary charging means) 82 for assisting recharging of the transfer residual toner to be collected by the developing device 4 is provided.

The operation of the above described image forming apparatus 200 will be described.

The photosensitive drum 1 is rotationally driven in the arrow direction and after being negatively charged uniformly by the charging roller 2 at its surface, is exposed to light by the exposure device 3 to form an electrostatic latent image corresponding to a color-separated image obtained by color-separation of an input original at the surface of the photosensitive drum 1. A toner image formed at the surface of the photosensitive drum 1 is primary-transferred onto the intermediary transfer belt 51 rotating at the same speed as that of the photosensitive drum 1 by the action of the primary transfer roller 52 in the primary transfer nip N1.

The above described operation is performed at each of the image forming stations P (PY, PM, PC, PK), so that toner images formed on the respective photosensitive drums 1 are successively transferred onto the intermediary transfer belt 51 in a superimposing manner. In the case of a full-color mode, the toner images are primary-transferred onto the intermediary transfer belt 51 in the order of those of Y (yellow), M (magenta), C (cyan), and K (black). Also in the cases of a single color mode or two or three color mode, necessary color toner or toners are successively transferred onto the intermediary transfer belt 51 in the superimposing manner in the same process as that described above. The resultant toner image formed in the superimposing manner are secondary-transferred by the action of the secondary transfer roller 53 onto the recording material S supplied to the secondary transfer nip N2 by the registration roller and the like. The recording material S onto which the toner images are secondary-transferred is heated and pressed by the fixing device 6 to fix thereon the toner images and is discharged to a sheet discharge tray 92.

On the other hand, the toner image on the photosensitive drum 1 after the primary transfer is electrically charged uniformly to the opposite polarity by the upstream auxiliary brush (upstream auxiliary charging means) 81 as the auxiliary charging device 8. Thereafter, the toner image is electrically charged to the normal polarity by the downstream auxiliary brush (downstream auxiliary charging means) 82 as the auxiliary charging device 8 in order not to deposit the transfer residual toner on the charging roller 2. Then, the toner image is collected in the developing device 4 by a voltage Vback during the developing operation by the developing device 4. The voltage Vback is a potential difference between a potential at a non-image portion on the photosensitive drum 1 and a DC voltage (Vdc) applied to the developing sleeve. From the intermediary transfer belt 51 after the secondary transfer onto the recording material is completed, the secondary transfer residual toner deposited on the intermediary transfer belt surface is removed and collected by the intermediary transfer member cleaner 56 having the cleaning blade.

[Process Operation]

(a) Drum and Charging

Figure 3:
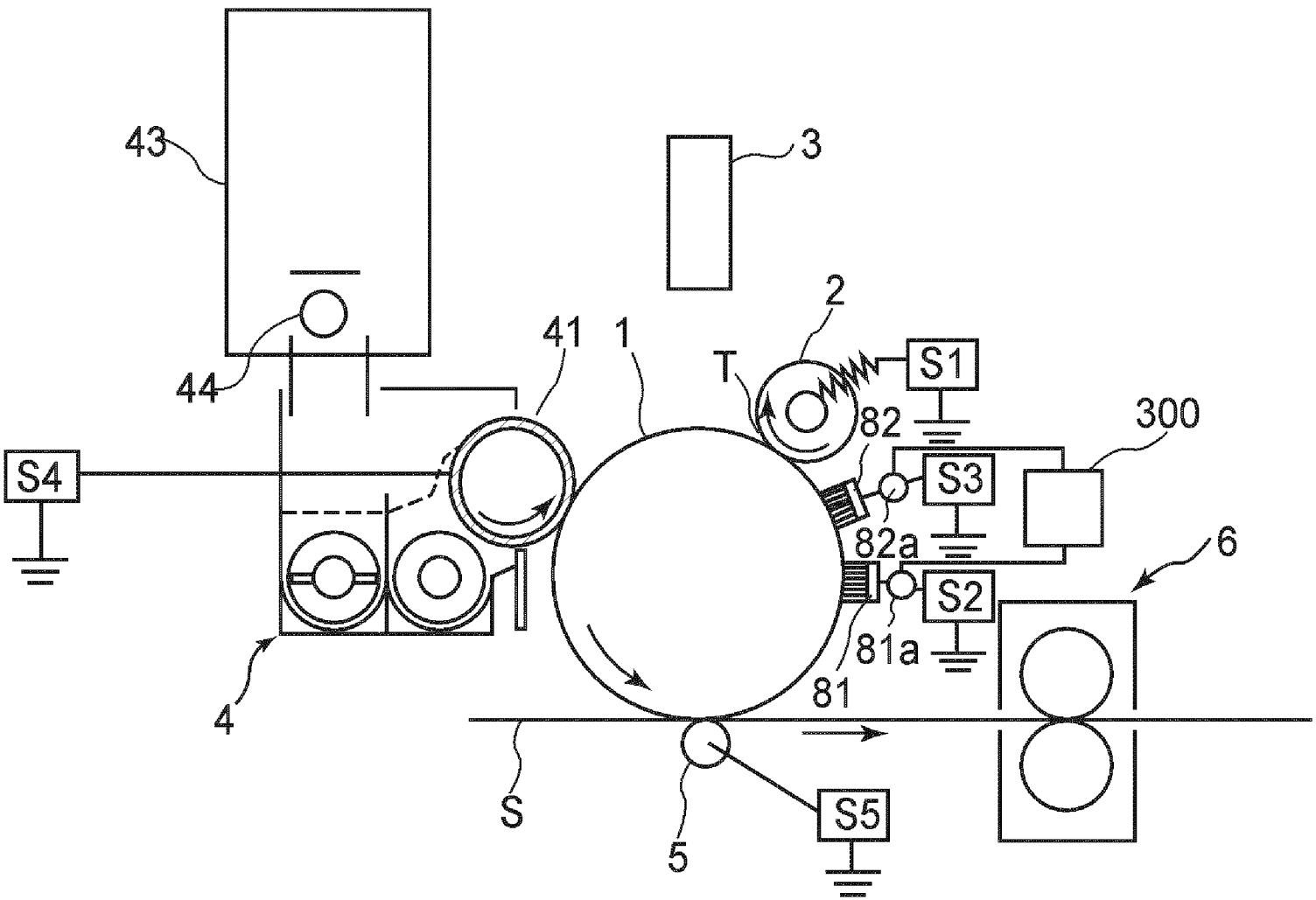
FIG. 3 is a schematic constitutional view of another embodiment of an electrophotographic image forming apparatus according to the present invention.

In this embodiment, the photosensitive drum 1 is a drum of a negatively chargeable organic photoconductor (OPC), which has an outer diameter of about 30 mm and is rotated at a process speed of 130 mm/sec in a counterclockwise direction as shown in FIGS. 2 and 3.

The charging roller 2 is rotatably held at both end portions of a core metal and is pressed against the surface of the photosensitive drum 1 at a predetermined pressing force and rotated by the rotation of the photosensitive drum 1.

In this embodiment, by applying an oscillating voltage in the form of an AC voltage consisting of a sinusoidal wave having a frequency of 1300 Hz and a peak-to-peak voltage of Vpp of 1300 V biased with a DC voltage of −550 V from a power source S1 to the charging roller 2, a peripheral surface of the photosensitive drum 1 is electrically charged uniformly in a contact charging manner. The resultant potential is a potential at the non-image portion.

(b) Auxiliary Charging

In this embodiment, as the auxiliary charging device 8, the upstream and downstream auxiliary charging means, i.e., the brush-like residual developer uniformizing means (upstream auxiliary brush) 81 and the brush-like residual developer charge amount control means (downstream auxiliary brush) 82 are provided.

To the upstream auxiliary brush 81 as the upstream auxiliary charging means, from a power source S2, an oscillating voltage in the form of an AC voltage biased with a DC voltage to positively charge the transfer residual toner mixedly including weakly negative polarity toner and positive toner.

Further, to the downstream auxiliary brush 82 as the downstream auxiliary charging means, from a power source S3, a DC voltage is applied to negatively charge the transfer residual toner so that the positively charged transfer residual toner can be collected and held and the transfer residual toner can be collected by the developing device 4 in combination with the charging roller 2. Further, both the upstream auxiliary brush 81 and the downstream auxiliary brush 82 are reciprocated at a predetermined period in a main scanning direction in order to obviate localization of toner deposition amount in the main scanning direction varying depending on an image to be formed.

In this embodiment, an oscillating voltage in the form of an AC voltage having a frequency of 1300 Hz and a peak-to-peak voltage Vpp of 200 V biased with a DC voltage of 250 V is applied from the power source S2 to the upstream auxiliary brush 81 and a DC voltage of −750 V is applied from the power source S3 to the downstream auxiliary brush 82.

(c) Exposure

In this embodiment, the exposure device 3 for forming the electrostatic latent image at the surface of the electrically charged photosensitive drum 1 is a laser beam scanner using a semiconductor laser. This laser beam scanner outputs laser light modulated in correspondence with an image signal sent from a host processing device such as an image reading device or the like to a printer side, thus subjecting the uniformly charged surface of the photosensitive drum 1 to laser scanning exposure. The exposed portion is an image portion. A potential at the image portion is set to about −150 V in this embodiment.

(d) Development

In this embodiment, a two-component developer in the form of a mixture of negatively chargeable polymerized toner having a particle size of 6 μm and a magnetic powder dispersed carrier having a particle size of 40 μm and an electric resistance of about $10^{13}$ Ω·cm is used. Further, in this embodiment, the developer is supplied to the developing sleeve 41 as the developer carrying member while being conveyed and stirred by a developer conveying and stirring member in the developing device 4. The developer supplied to the developing sleeve 41 is coated no the developing sleeve 41 in a thin layer by a developer amount regulating means (developing blade) 42. The developing sleeve 41 supplies the toner to the photosensitive drum 1 in an opposing area by a counter development method in which a rotation direction of the developing sleeve 41 is opposite (counter) to that of the photosensitive drum 1.

Further, in this embodiment, a developing bias voltage applied from a power source S4 to the developing sleeve 41 is an oscillating voltage in the form of an AC voltage biased with a DC voltage. More specifically, the oscillating voltage is in the form of an AC voltage having a frequency of 1300 Hz and a peak-to-peak voltage Vpp of 1600 V biased with a DC voltage of −400 V.

(e) Transfer

In this embodiment, the transferring device 5 is of the type wherein the toner is transferred from the photosensitive drum 1 to the recording material S through the intermediary transfer belt (ITB) 51 as the intermediary transfer member.

The intermediary transfer belt 51 is pressed against the photosensitive drum 1 at a predetermined pressing force by the primary transfer roller 52 at the primary transfer portion N1 at which the toner is transferred from the photosensitive drum 1 onto the intermediary transfer belt 51. Further, the recording material S is pressed against the intermediary transfer belt 51 at a predetermined pressing force by the secondary transfer roller 53 at the secondary transfer portion N2 at which the toner is transferred from the intermediary transfer belt 51 onto the recording material S. In this embodiment, a primary transfer voltage of about 400 V is applied from a power source S5 and a primary transfer nip load is about 300 g. Further, a secondary transfer voltage is about 1000 V and a secondary transfer nip load is about 500 g.

(f) Fixing

In this embodiment, as the fixing device 6, a roller fixing device is used at a process speed of 130 mm/sec and an average fixing temperature of 190° C.

[Collecting Constitution of Reversely Charged Toner]

In this embodiment, a reversely charged toner collecting mode is executed during non-image formation (e.g., post-rotation) after a series of image forming operations.

Figure 4:
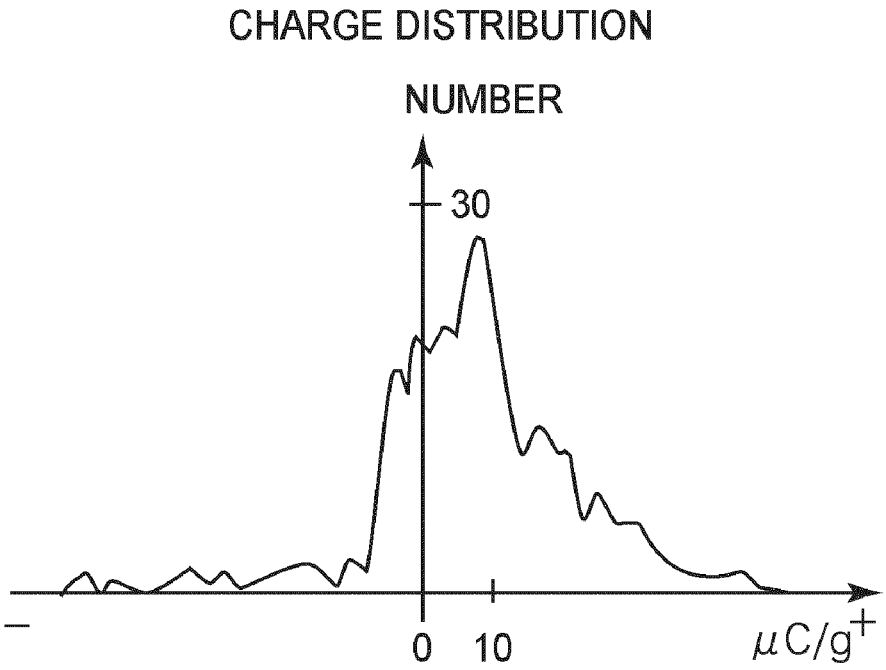
FIG. 4 is a graph showing a distribution of an amount of charge of fog toner on a photosensitive drum.

First, without using the present invention, an image having an image duty (print ratio) of 5% was formed on an A4-size recording sheet. Image formation was performed by 250 sets of image forming jobs each including continuous printing on 200 sheets, i.e., 50,000 sheets in total. The print ratio is a proportion of an actually image formed area to a maximum image forming area. As a result, when a fog density on the photosensitive drum 1 was measured by a reflection density meter, the fog density was about 2.5%, thus remarkably lowering an image quality. In this case, a distribution of charge amount of the fog toner is as shown in FIG. 4, wherein a large amount of the reversely charged toner as a positive toner component T is present. Further, it was confirmed that on the photosensitive drum 1, a deposited matter of fused toner other than the fog toner was present, i.e., filming occurred.

In this embodiment, the collecting mode of the reversely charged toner (i.e., the positive toner) to be executed in the constitution of the present invention was executed during the post-rotation (i.e., during the non-image formation) after the continuous image formation on 200 sheets (after one job). Further, the printing on 50,000 sheets was performed while the fog toner as the positive toner component carried by the photosensitive drum 1 was collected.

Figure 5:
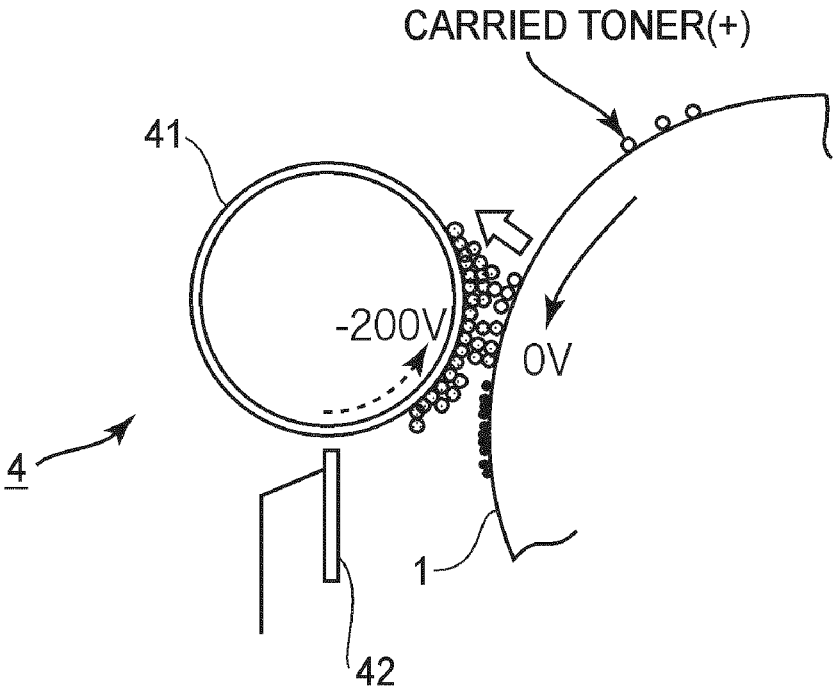
FIG. 5 is a schematic view for illustrating a collecting constitution of positive toner in the present invention.
Figure 6:
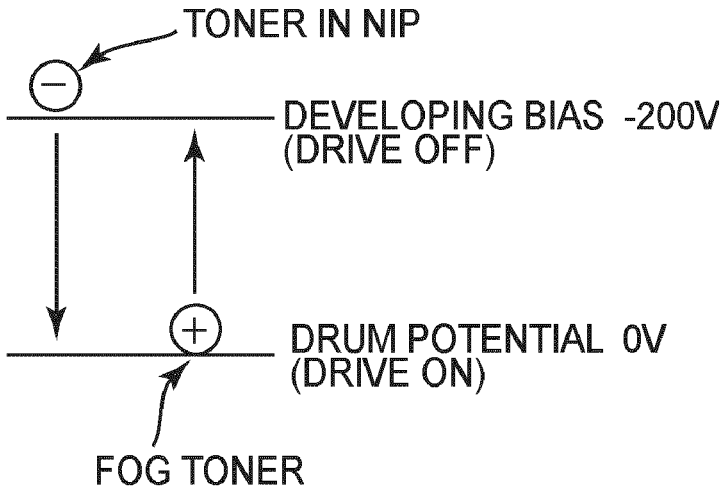
FIGS. 6(*a*) and 6(*b*) are schematic views showing positive toner collecting models.
Figure 6:
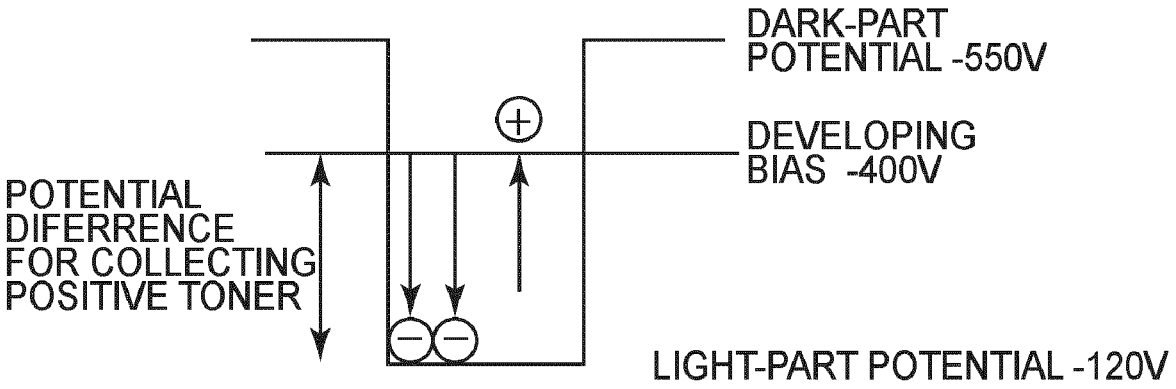
Figure 7:
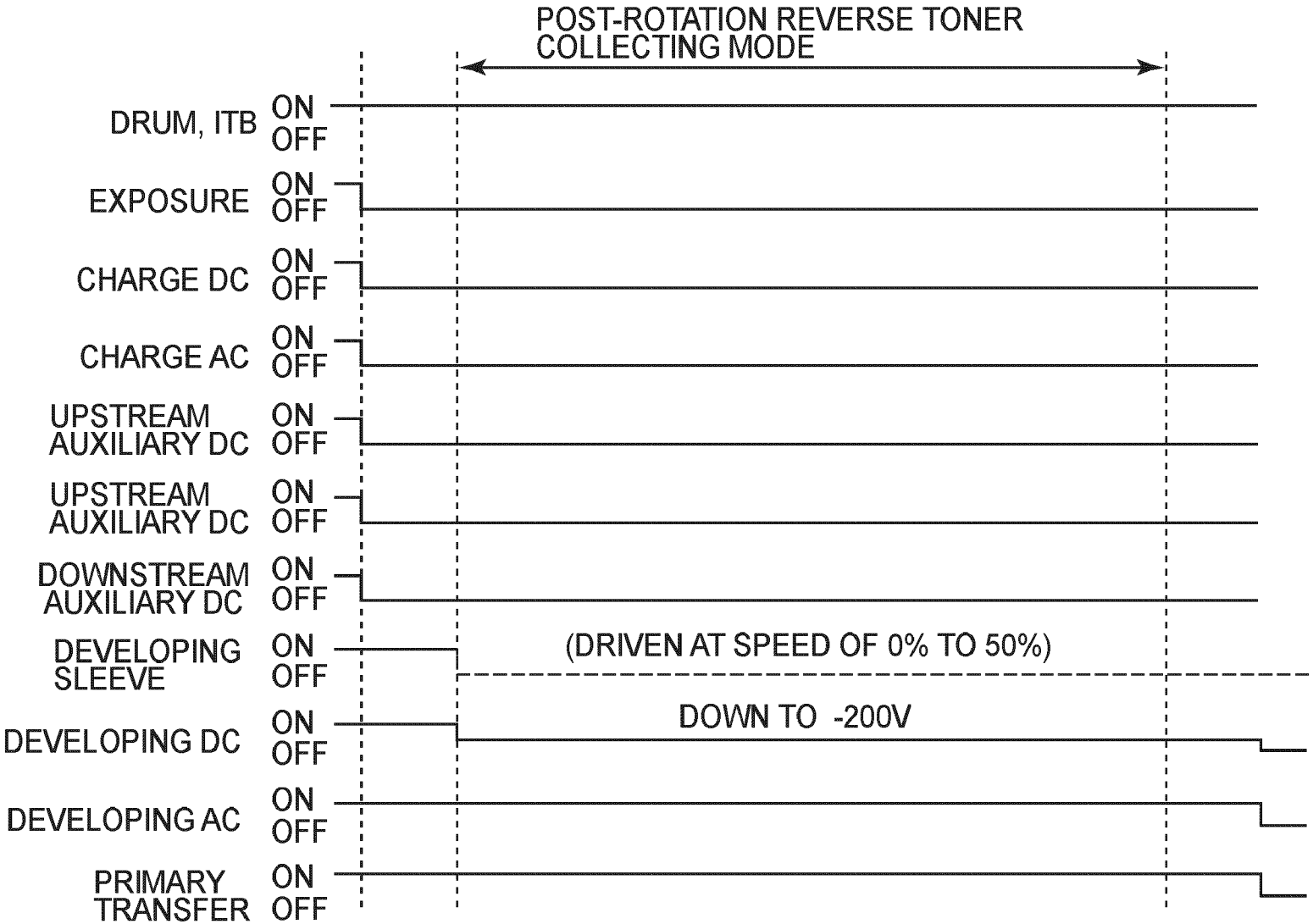
FIG. 7 is a time chart showing a sequence of a positive toner collecting mode in Embodiment 1 of the present invention.

The constitution in accordance with the present invention in the positive toner collecting mode will be described with reference to FIGS. 5 to 7. The positive toner collecting mode is executed by control by means of a controller 300 as a control means.

According to the present invention, during the post-rotation after the job is completed, a rotational speed of the developing device 4, i.e., the developing sleeve 41 is decreased to 50% or less of that during ordinary image formation and the photosensitive drum 1 and the intermediary transfer belt 51 are rotated at rotational speeds equal to those during the ordinary image formation. In this embodiment, the rotational speed of the developing sleeve 41 is 10% of that during the ordinary image formation. In this case, a voltage is not applied to the charging roller 2, a surface potential of the photosensitive drum 1 is 0 V, and a voltage consisting of a DC voltage of −200 V and an AC voltage of 1600 V is applied to the developing sleeve 41 as a positive toner collecting bias. In the positive toner collecting mode, operation states of the respective constitutional factors are shown in a time chart of FIG. 7. Further, as shown in FIG. 6(*a*), the positive toner on the photosensitive drum 1 is collected in the developing device 4 by the potential difference between the surface of the photosensitive drum 1 and the developing sleeve and the oscillating voltage and is stirred together with the developer in the developing device 4 to be subjected to a subsequent developing process while possessing the normal charge polarity. On the other hand, the toner on the developing sleeve 41 is transferred onto the photosensitive drum 1. However, the peripheral speed of the developing sleeve 41 is decreased, so that consumption of the positive-polarity toner can be suppressed.

Further, to the primary transfer portion N1, the voltage of 400 V kept as it is after the image formation is applied thereby to transfer the toner consumed at the developing nip portion onto the intermediary transfer belt 51 as it is and is then collected by the intermediary transfer member cleaner 56.

When the fog density on the photosensitive drum 1 after the image formation using the collecting mode in the present invention is performed in the same manner as that described above, i.e., on continuous 200 sheets for each job and 50,000 sheets in total was measured, the fog density was about 1%, so that it was possible to obtain a good quality image. Further, a level of the filming generated by the positive toner carried on the photosensitive drum 1 and strongly adhered to the photosensitive drum 1 by the pressing force from the charging roller 2 was also improved.

Figure 8:
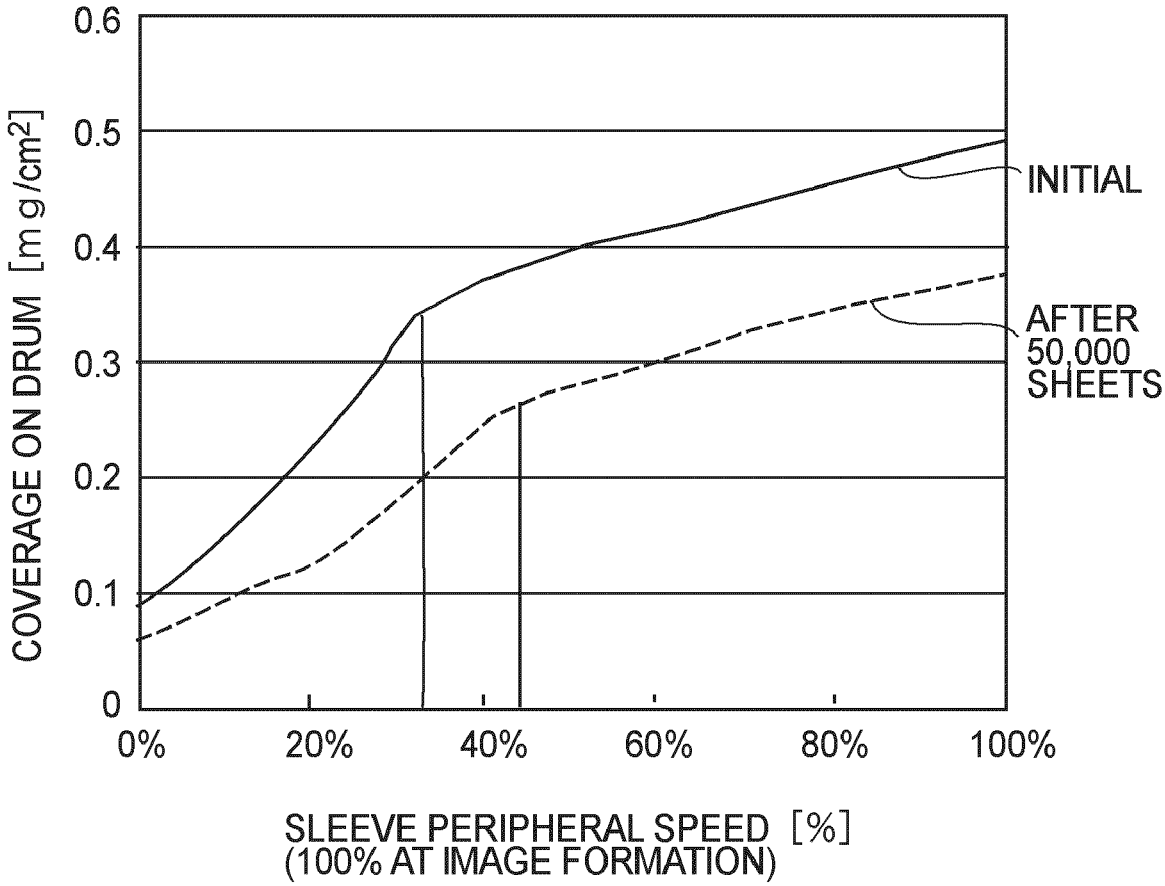
FIG. 8 is a graph showing a relationship between a rotational speed of a developer carrying member and an amount of toner subjected to development.

FIG. 8 shows a relationship between a rotational speed of the developing sleeve 41 and an amount of toner electrically charged to the normal charge polarity. With respect to the developer at an initial stage, when the rotational speed of the developing sleeve 41 is decreased to about 30% or less of that during the ordinary image formation, an amount of toner subjected to development on the photosensitive drum 1 is significantly decreased. With respect to the developer after being subjected to the image formation on 50,000 sheets, when the rotational speed is decreased to about 50% or less of that during the ordinary image formation, the amount of toner subjected to development on the photosensitive drum 1 tends to be significantly decreased. Therefore, in order to reduce consumption of the toner electrically charged to the normal charge polarity in the positive toner collecting mode, a deceleration ratio of the driving speed of the developing device 4 may preferably be 50% or less and a toner consumption reducing effect is largest when the drive of the developing device 4 is completely stopped. Further, a collecting performance for the positive toner little depends on the driving speed of the developing device 4.

According to this embodiment, a lifetime (about 40,000 sheets) of the photosensitive member (OPC) can be prolonged by 10,000 sheets or more to significantly reduce running cost.

Embodiment 2

Figure 9:
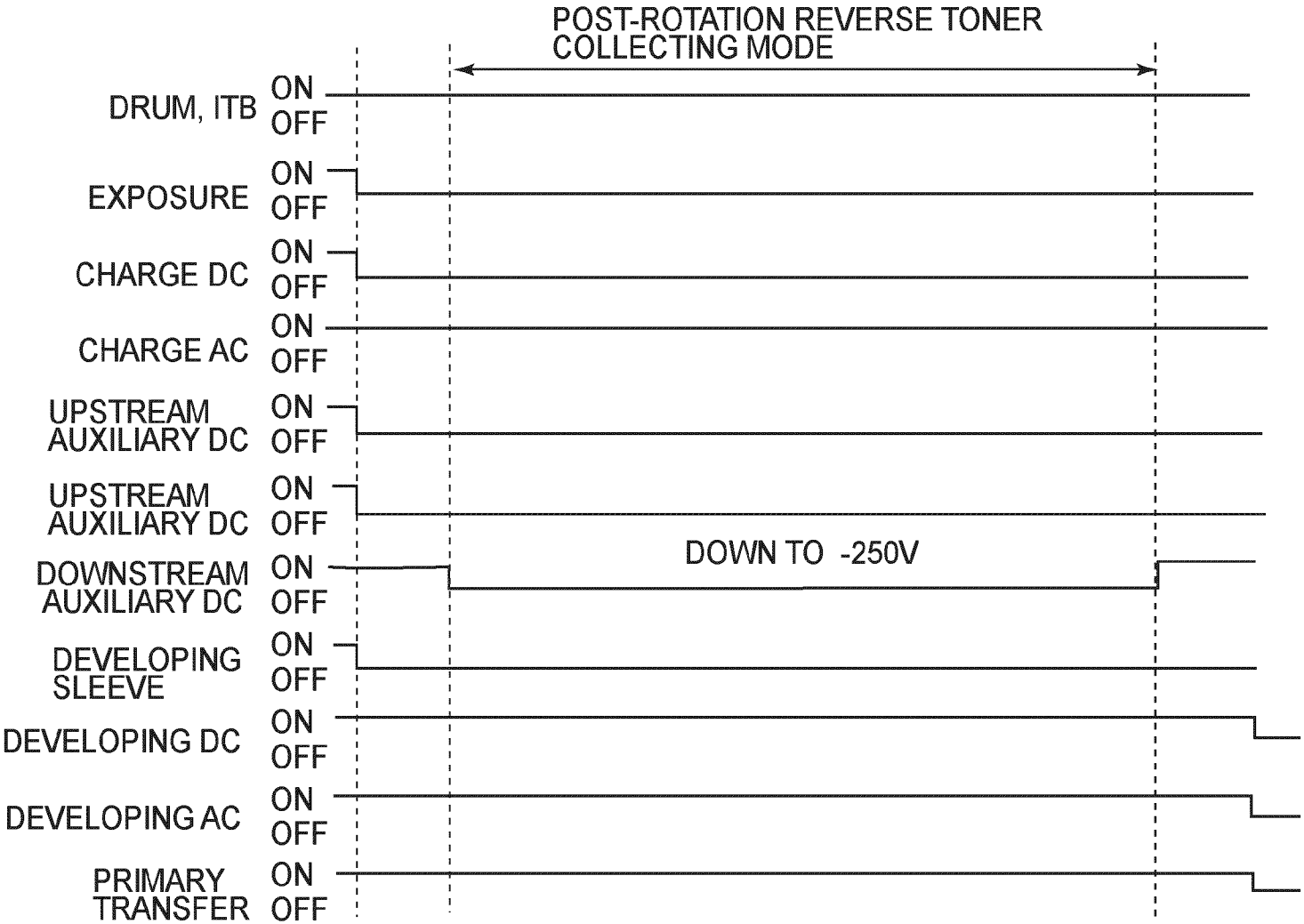
FIGS. 9 and 10 are time charts showing sequences of positive toner collecting modes in Embodiment 2 and Embodiment 3, respectively, of the present invention.

With reference to FIG. 9, another embodiment of the present invention will be described. A fundamental structure (constitution) of an image forming apparatus of this embodiment is identical to that of the image forming apparatus 200 in Embodiment 1, so that members substantially having the same constitution and function as those for the image forming apparatus 200 in Embodiment 1 are represented by identical reference numerals or symbols and detailed description thereof will be omitted with the help of the description in Embodiment 1.

In this embodiment, a constitution in which in the case where positively charged toner (positive toner) is deposited on a charging roller 2 having a negative polarity, the positive toner deposited on the charging roller 2 is discharged on a photosensitive drum 1 and is collected simultaneously with positive toner carried on the photosensitive drum 1 is shown.

Similarly as in Embodiment 1, as a constitution during post-rotation, a developing sleeve 41 was stopped immediately after completion of a job and the photosensitive drum 1 and an intermediary transfer belt 51 were rotated at rotational speeds equal to those during image formation.

In this case, in this embodiment, the surface of the photosensitive drum 1 was negatively charged by applying a DC voltage of −250 V to a downstream auxiliary brush 82 as an auxiliary charging device 8. At this time, a potential at the surface of the photosensitive drum 1 was about −200 V. Further, to the charging roller 2, as a bias for discharging the positive toner onto the photosensitive drum 1, a DC voltage of 0 V and an AC voltage having a frequency of 1300 Hz and a peak-to-peak voltage of 1300 V were applied. Further, to the developing sleeve 41, a bias for collecting the positive toner carried on the photosensitive drum 1 and the above described positive toner discharged from the charging roller 2 is applied. This bias includes a DC voltage of −400 V and an AC voltage of 1600 V. To a primary transfer portion N1, a voltage of 400 V kept as it is after the image formation is applied.

In this embodiment, a reversely charged toner collecting mode for performing an operation by the constitution of this embodiment is executed during post-rotation after image formation is continuously performed on 200 sheets (after completion of one job). In this collecting mode, image formation on 50,000 sheets was performed while fog toner consisting of the positive toner carried on the photosensitive drum 1 and the positive toner deposited on and contaminating the charging roller 2 were collected.

By the above described constitution, the filming level improved in Embodiment 1 was improved to the extent that it was retained at a level equal to the initial level. Further, a degree of the charging roller contamination, so that a fluctuation in dark-part potential Vd by the image formation on 50,000 sheets and a fluctuation in toner collecting potential Vback by the fluctuation in Vd were alleviated.

For this reason, when a fog density on the photosensitive drum at the time when the image formation on 50,000 sheets was performed, the fog density was 1% or less, so that a higher quality image was obtained in this embodiment.

Further, when the image formation was continued, the above described image level was retained until 80,000 sheets, so that it was possible to significantly improve lifetimes of image forming stations.

Embodiment 3

Figure 10:
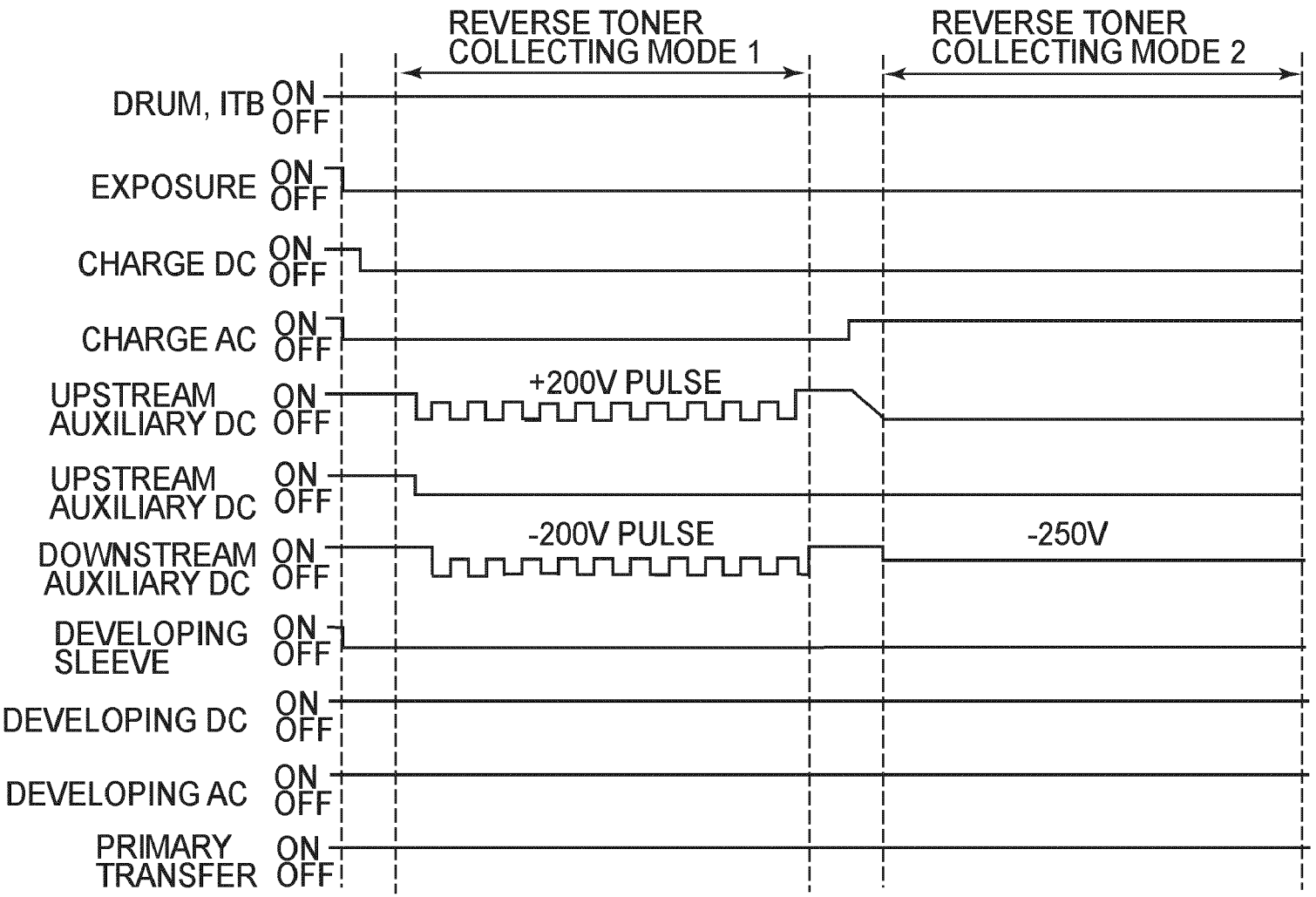
Figure 11:
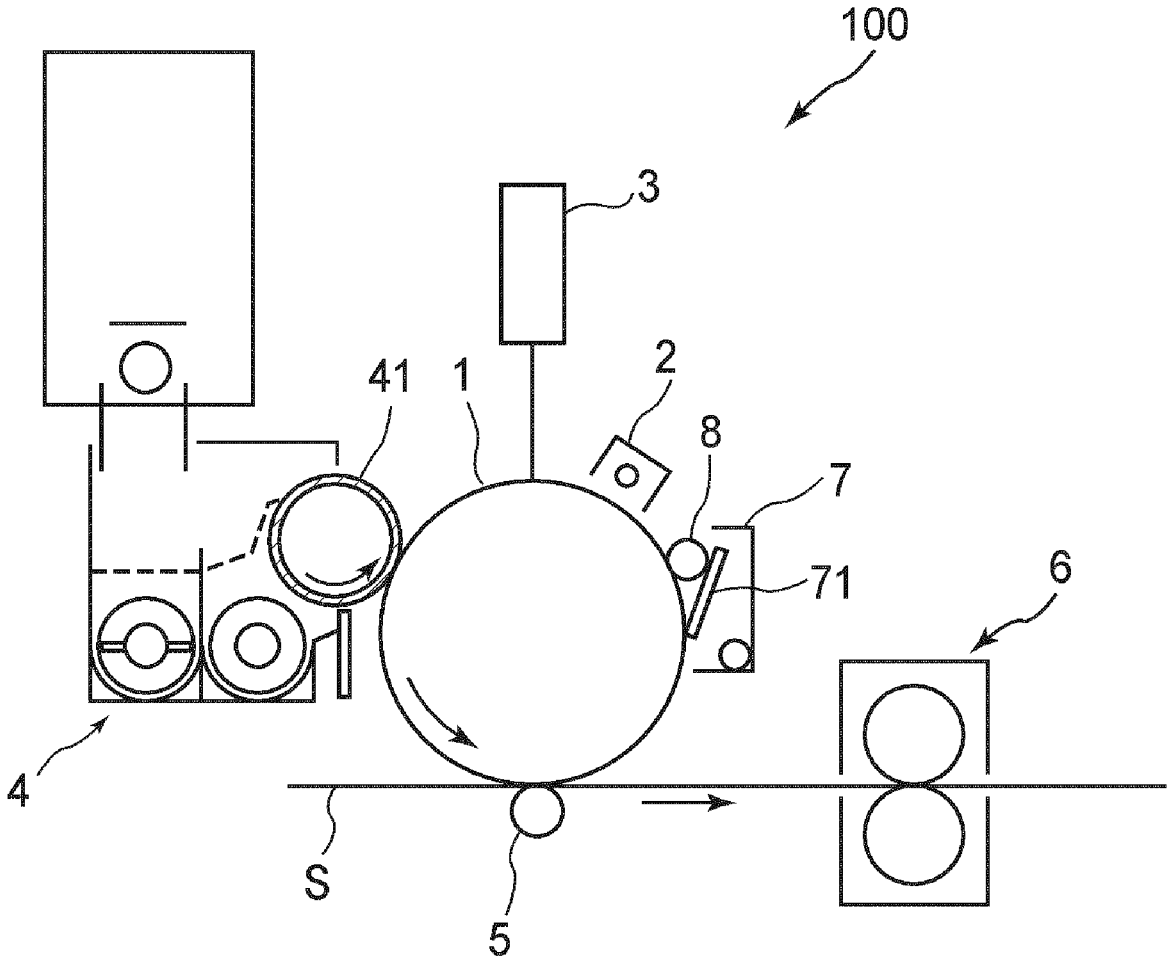
FIG. 11 is a schematic constitutional view showing an embodiment of a conventional electrophotographic image forming apparatus.

With reference to FIG. 10, another embodiment of the present invention will be described. A fundamental structure (constitution) of an image forming apparatus of this embodiment is identical to that of the image forming apparatus 200 in Embodiment 1, so that members substantially having the same constitution and function as those for the image forming apparatus 200 in Embodiment 1 are represented by identical reference numerals or symbols and detailed description thereof will be omitted with the help of the description in Embodiment 1.

In this embodiment, a constitution in which positive toner held by a downstream auxiliary brush 82 as an auxiliary charging device 8 and positive toner deposited on a charging roller 2 are collected simultaneously with positive toner carried on a photosensitive drum 1 is shown.

Similarly as in Embodiments 1 and 2, as a constitution of the positive toner collection, a developing sleeve 41 is stopped during post-rotation after completion of a job and the photosensitive drum 1 and an intermediary transfer belt 51 are rotated at rotational speeds equal to those during image formation.

In this embodiment, the toner collecting mode includes a first reversely charged toner collecting mode 1 and a second reversely charged toner collecting mode 2. First, in the first reversely charged toner collecting mode 1, a bias is not applied to the charging roller 2 and on the other hand, pulse voltages are applied to an upstream auxiliary brush 81 and the downstream auxiliary brush 82 as the auxiliary charging device 8. As a result, negative toner and positive toner deposited on the auxiliary brushes 81 and 82, respectively, are discharged onto the photosensitive drum 1.

In this case, the negative toner is collected by an intermediary transfer member cleaner 56 after being transferred onto an intermediary transfer belt 51 since the negative toner is strongly charged negatively when it is discharged from the auxiliary charging device 8 and generates positive toner when it is collected in the developing device 4. On the other hand, the positive toner is collected by the developing device 4.

In a subsequent second reversely charged toner collecting mode 2, a negative potential is applied to the surface of the photosensitive drum 1 by the downstream auxiliary brush 82 to cause the positive toner deposited on the charging roller 2 to be discharged onto the photosensitive drum 1 similarly as in Embodiment 2, so that the positive toner is collected by the developing device 4.

More specifically, ordinarily, when an image forming operation is performed, a DC voltage of 200 V is applied to the upstream auxiliary brush 81 as the auxiliary charging device 8, so that the negative toner as the transfer residual toner is deposited on the upstream auxiliary brush 81. Further, a DC voltage of −750 V is applied to the downstream auxiliary brush 82, so that the positive toner as the transfer residual toner and the positive toner changed in polarity from the negative toner by the upstream auxiliary brush 81 are held by the downstream auxiliary brush 82. Further, a DC voltage of −550 V is applied to the charging roller 2, so that the positive toner is deposited on the charging roller 2.

In the first reversely charged toner collecting mode 1, by alternately applying potentials of 200 V and 0 V ten times with a period of 200 msec to the upstream auxiliary brush 81, the negative toner is subjected to electrical oscillation to be eliminated from the brush, thus being discharged on the surface of the photosensitive drum 1. Further, to the downstream auxiliary brush 82, potentials of 0 V and −200 V are alternately applied ten times with a period of 200 msec, so that the positive toner is discharged on the surface of the photosensitive drum 1. By abruptly applying the potentials changed between 0 V to −200 V, a large current transiently flows from the brush into the photosensitive drum 1. For this reason, the surface of the photosensitive drum 1 has a potential of −200 V or more, so that a potential difference is generated.

The positive toner of the downstream auxiliary brush 82 is deposited and discharged on the surface of the photosensitive drum 1 electrostatically by the potential difference. In this case, the positive toner is discharged with a period shifted by half period so that the discharge position does not overlap with the discharge position of the toner discharged from the upstream auxiliary brush 81.

In this case, a voltage is not applied to the charging roller 2, so that the toner discharged from the auxiliary charging device 8 is passed through the charging roller 2 without stopping. To the developing sleeve 41, as a collecting voltage for the positive toner, a DC voltage of −400 V and an AC voltage of 1600 V are applied. The negative toner discharged from the upstream auxiliary brush 81 is transferred onto the intermediary transfer belt 51 at a transfer position and collected by the intermediary transfer member cleaner 56.

Then, in the second reversely charged toner collecting mode 2, to the downstream auxiliary brush 82, a voltage of −250 V is applied, so that the surface of the photosensitive drum 1 is negatively charged. Further, to the charging roller 2, a DC voltage of 0 V and an AC voltage having a frequency of 1300 Hz and a peak-to-peak voltage of 1300 V are applied, so that the positive toner on the charging roller 2 is discharged on the photosensitive drum 1. The positive toner discharged on the surface of the photosensitive drum 1 is collected in the developing device 4 and stirred together with the developer in the developing device 4, so that the resultant developer is subjected again to the developing process.

By the above described constitution, the filming level at the time of performing image formation on 50,000 sheets was improved to the extent that it was retained at a level equal to the initial level. Further, a degree of the charging roller contamination, so that a fluctuation in dark-part potential Vd by the image formation on 50,000 sheets and a fluctuation in toner collecting potential Vback by the fluctuation in Vd were alleviated.

For this reason, when a fog density on the photosensitive drum at the time when the image formation on 50,000 sheets was performed, the fog density was 1% or less, so that a higher quality image was obtained in this embodiment.

Further, when the image formation was continued, the above described image level was retained until 80,000 sheets, so that it was possible to significantly improve lifetimes of image forming stations.

Embodiment 4

Another embodiment of the present invention will be described. A fundamental structure (constitution) of an image forming apparatus of this embodiment is identical to that of the image forming apparatus 200 in Embodiment 1, so that members substantially having the same constitution and function as those for the image forming apparatus 200 in Embodiment 1 are represented by identical reference numerals or symbols and detailed description thereof will be omitted with the help of the description in Embodiment 1.

In the embodiments 1 to 3 described above, at regular time intervals, the sequence of the positive toner collecting mode is performed during the post-rotation between jobs. However, contamination of the photosensitive drum 1, the charging roller 2, and the upstream and downstream auxiliary brushes 81 and 82 is caused by generation of the positive toner in the developing device 4 by collecting the toner deteriorated by the continuous image formation and the strongly negatively charged toner through the simultaneous development and cleaning. For this reason, a degree of initial contamination is slight but the above described sequence is frequently performed, so that downtime can be rather increased.

In this embodiment, storing means (400Y, 400M, 400C, and 400K), i.e., IC tags (memories) are provided to the image forming portions, i.e., the image forming stations P, and the number of sheets subjected to image formation at an associated image forming station P is written and counted in an associated storing means as IC tag information. The thus counted sheet number stored in the IC tag is read by a controller. Based on the counted sheet number, a table showing a relationship between an image forming sheet number and an execution frequency stored in a read-only memory (ROM) provided as a storing device to the image forming apparatus is referred to. Then, a judgment as to whether the sequence of the collecting mode including the constitutions of the present invention described in Embodiment 1 to Embodiment 3 is executed or not is made.

More specifically, the sequence is performed after completion of a series of jobs based on the image formation sheet number stored in the above described table.

In this embodiment, the positive toner collection of the positive toner is performed by the constitution described in Embodiment 3. Specifically, in this embodiment, the positive toner collection described above is performed in accordance with the following setting.

That is, the positive toner constitution was performed by executing a collecting mode every 20,000 sheets from a first sheet to a 10,000-th sheet, every 1,000 sheets from a 10,001-th sheet to a 20,000-th sheet, and every 500 sheets from a 20,001-th sheet to a 40,000-th sheet with respect to 40,000 sheets which was a lifetime of a conventional photosensitive drum 1.

In this case, with respect to levels of fog and contamination, it was possible to keep good levels until about 80,000 sheets similarly as in Embodiment 3. When the positive toner collecting mode is executed every 200 sheets, the positive toner collecting mode is executed 250 times, when the image formation on 50,000 sheets is performed. However, in this embodiment, the positive toner collecting mode was executed until 50,000 sheets, so that it was possible to significantly educe downtime compared with the constitutions of Embodiment 1 to Embodiment 3. Particularly, it was possible to significantly reduce the frequency of the positive toner collection at an initial stage.

Embodiment 5

Another embodiment of the present invention will be described. A fundamental structure (constitution) of an image forming apparatus of this embodiment is identical to that of the image forming apparatus 200 in Embodiment 1, so that members substantially having the same constitution and function as those for the image forming apparatus 200 in Embodiment 1 are represented by identical reference numerals or symbols and detailed description thereof will be omitted with the help of the description in Embodiment 1.

In this embodiments 1 to 3 described above, at regular time intervals, the sequence of the positive toner collecting mode is performed during the post-rotation between jobs. However, contamination of the photosensitive drum 1, the charging roller 2, and the upstream and downstream auxiliary brushes 81 and 82 is caused by collecting, in the developing device 4, the toner deteriorated by the continuous image formation and the strongly negatively charged toner through the simultaneous development and cleaning. That is, the contamination is caused by generation of the positive toner in the developing device 4 by collecting the above described toners. For this reason, a degree of initial contamination of the photosensitive drum 1, the charging roller 2, and the upstream and downstream auxiliary brushes 81 and 82 is slight but the above described sequence is frequently performed, so that downtime can be rather increased.

Further, the contamination of the upstream and downstream auxiliary brushes 81 and 82 as the auxiliary charging device 8 or the charging roller 2 with the positive toner carried on the photosensitive drum 1 is frequently caused in the case of forming a high duty image. This is because the amount of the transfer residual toner in the case of forming the high duty image is higher than that in the case of forming a low duty image. For this reason, in the case of forming the low duty image of a print ratio of 5% as in Embodiment 4, it is possible to reduce the downtime by the above described constitution. However, in the case of continuously forming the high duty image when the frequency of the positive toner collecting mode at the initial stage is low, the contamination of the photosensitive drum 1, the charging roller 2, and the upstream and downstream auxiliary brushes 81 and 82 is caused before execution of a subsequent positive toner collecting mode. As a result, an image quality can be lowered. In the present invention, the positive toner collecting mode is executed at the time when the print ratio reaches a predetermined value (a reference value determined in advance). In this embodiment, the predetermined value is 10%.

In this embodiment, image formation on 50,000 sheets similarly as in Embodiment 4 was performed in such a manner that a 5%-duty A4-size image was formed on 200 sheets and thereafter a 20%-duty A3-size image was formed on 10 sheets. First, the image formation was performed by the method of Embodiment 4 and when the fog density on the photosensitive drum 1 was measured at the time when the image formation on 50,000 sheets was completed, the fog density was 1.5%, so that a resultant image quality was lowered compared with the cases where the 5%-duty image was formed by the methods of Embodiment 1 to Embodiment 4.

In addition to the method of Embodiment 4, the positive toner collecting mode was also executed after the job for the high duty image was completed. In this case, when the image formation on 50,000 sheets was performed in a similar manner and then the fog density on the photosensitive drum 1 was measured, the fog density was 1% or less to provide a good image. Further, the contamination of the photosensitive drum 1, the charging roller 2, and the auxiliary charging device 8 was well alleviated.

According to this Embodiment, it was possible to improve the lifetime of the image forming portion P while the contamination of the photosensitive drum 1, the charging roller 2, and the auxiliary charging device 8 was alleviated and the downtime was reduced.

Embodiment 6

Another embodiment of the present invention will be described. A fundamental structure (constitution) of an image forming apparatus of this embodiment is identical to that of the image forming apparatus 200 in Embodiment 1, so that members substantially having the same constitution and function as those for the image forming apparatus 200 in Embodiment 1 are represented by identical reference numerals or symbols and detailed description thereof will be omitted with the help of the description in Embodiment 1.

In this embodiments 1 to 3 described above, the sequence of the positive toner collecting mode is performed during the post-rotation between jobs. However, contamination of the photosensitive drum 1, the charging roller 2, and the upstream and downstream auxiliary brushes 81 and 82 is caused by collecting, in the developing device 4, the toner deteriorated by the continuous image formation and the strongly negatively charged toner through the simultaneous development and cleaning. That is, the contamination is caused by generation of the positive toner in the developing device 4 by collecting the above described toners. For this reason, a degree of initial contamination of the photosensitive drum 1, the charging roller 2, and the upstream and downstream auxiliary brushes 81 and 82 is slight but the above described sequence is frequently performed, so that downtime can be rather increased.

In this embodiment, as shown in FIG. 2, as shown in FIG. 2, ammeters 81*a* and 82*a* as detecting means for detecting amounts of currents passing through the upstream and downstream auxiliary brushes 81 and 82, respectively, as the auxiliary charging device 8 are provided and detected values are monitored by a controller 300 as a control means. Values of the currents passing through the upstream and downstream auxiliary brushes 81 and 82 are ordinarily about 20 μA±10 μA, and these brushes hold the toner and external additive to be contaminated with the toner and external additive, thus increasing electric resistances to lower the amounts of the currents. In this embodiment, a threshold value is taken as 10 μA and a judgment as to whether the contamination of the brushes is caused or not is made by the above described ammeters 81*a* and 82*a* and the controller 300. As a result, a judgment as the whether the positive toner collecting mode should be executed or not is made.

When the controller 300 judges that the brushes are contaminated, if a reserved sheet number for an executing job is 100 sheets or less, the positive toner collecting mode is executed after completion of the job. If the reserved sheet number is not less than 100 sheets, the positive toner collecting mode is executed immediately after the image formation on 100 sheets is performed.

In this embodiment, image formation was performed in such a manner that a job for forming a 5%-duty A4-size image on 200 sheets and a job for forming a 20%-duty A3-size image on 10 sheets were performed in an arbitrary order with an arbitrary number of executions. First, when the fog density on the photosensitive drum 1 at the time when the image formation on 50,000 sheets was performed is measured, the fog density was about 1.0% or less, thus resulting in a good level. Further, filming or the like was not caused on the photosensitive drum 1 and there was no contamination of the charging roller 2 and the auxiliary charging device 8. When the sheet number exceeded 85,000 sheets, the fog density first exceeded 1.0% and the filming started to occur on the photosensitive drum 1 to some degree. In this embodiment, the positive toner collecting mode executed during the image formation was one time per 500 sheets to 1500 sheets.

According to this embodiment, it was possible to effectively prevent the deposition of the positive toner causing the contamination of the photosensitive drum 1, the charging roller 2, and the auxiliary charging device 8 and it was possible to prevent fog on the photosensitive drum 1, so that it was possible to prolong the lifetime of the image forming station P. Further, by executing the positive toner collecting mode on the basis of the result of detection of the current amount of the auxiliary charging device 8, it was possible to compatibly realize the reduction in downtime and the long lifetime of the image forming station P.

In the above described embodiment, the present invention is described so that it is applicable to the image forming apparatus of the intermediary transfer type but the image forming apparatus of the present invention is not limited thereto.

More specifically, for example, the present invention is also similarly applicable to an image forming apparatus of the type wherein the toner image on the photosensitive drum 1 is directly transferred onto the recording medium, i.e., the transfer material S as schematically shown in FIG. 3. The image forming apparatus shown in FIG. 3 includes an image forming portion having the same constitution as that of the image forming portion of the image forming apparatus described with reference to FIGS. 1 and 2. The image forming apparatus shown in FIG. 3 is also capable of achieving the same action and effect as those of the image forming apparatuses of the above described embodiments.

In the present invention, the developer may also be a developer, other than the above described developer, such as a mono-component developer. A developing means using the mono-component developer is well known in the art.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 255070/2006 filed Sep. 20, 2006, which is hereby incorporated by reference.

What is claimed is:

1. An image forming apparatus comprising:

a charging device for electrically charging a surface of an image bearing member;

an exposure device for exposing the surface of the image bearing member to light to form an electrostatic image;

a developing device, comprising a rotatable developer carrying member for carrying a developer, for developing the electrostatic image on the image bearing member into a developer image;

a transferring device for transferring the developer image from the image bearing member onto a transfer medium at a transfer position;

wherein said developing device is capable of collecting a developer remaining on the image bearing member without being transferred during the transfer, and a controller for executing, during non-image formation, a developer collecting mode in which a developer of a polarity opposite to a normal polarity remaining on the image bearing member is collected into said developing device by driving the image bearing member and by causing the developer carrying member to stop its rotation or rotate at a speed slower than a rotational speed thereof during image formation while generating a potential difference, between the image bearing member and the developer carrying member, capable of transferring the developer of the polarity opposite to the normal polarity from the image bearing member onto the developer carrying member.

2. An apparatus according to claim 1, wherein the image bearing member in the developer collecting mode is rotationally driven at a rotational speed in the range from 0% to 50% of a rotational speed of the image bearing member during image formation.

3. An apparatus according to claim 1, wherein said charging device is a contact charging device for effecting charging in contact with the surface of the image bearing member.

4. An apparatus according to claim 3, wherein said image forming apparatus further comprises:

a first auxiliary charging device provided at a position downstream from the transfer position and upstream from said charging device, wherein said charging device is capable of applying a DC voltage and an AC voltage, and wherein in the developer collecting mode, the DC voltage is applied to said first auxiliary charging device to electrically charge the image bearing member to a polarity identical to the normal polarity of the developer and only the DC voltage is applied to said charging device to transfer a developer deposited on said charging device onto the image bearing member.

5. An apparatus according to claim 3, wherein said image forming apparatus further comprises:

a first auxiliary charging device provided at a position downstream from the transfer position and upstream from said charging device; and a second auxiliary charging device provided at a position downstream from the transfer position and upstream from said first auxiliary charging device;

wherein said charging device is capable of applying a DC voltage and an AC voltage, wherein said controller is capable of executing a first developer collecting mode and a second developer collecting mode as the developer collecting mode, wherein in the first developer collecting mode, a pulse voltage is applied to the first and second auxiliary charging devices to transfer a developer deposited on the first and second charging devices onto the image bearing member, and wherein in the second developer collecting mode, the DC voltage is applied to said first auxiliary charging device to electrically charge the image bearing member to a polarity identical to the normal polarity of the developer and only the DC voltage is applied to said charging device to transfer a developer deposited on said charging device onto the image bearing member.

6. An apparatus according to claim 1, wherein said image forming apparatus further comprises:

a memory for storing information on the number of sheets subjected to image formation by an image forming operation, wherein said controller changes a frequency of execution of the developer collecting mode on the basis of the information stored in the memory.

7. An apparatus according to claim 1, wherein in the case where an image forming operation for providing a print ratio exceeding a reference value is continuously performed, said controller executes the developer collecting mode during post-rotation after the continuously performed image forming operation.

8. An apparatus according to claim 4, wherein said image forming apparatus further comprises:

a current amount detecting device for detecting an amount of a current passing through said first auxiliary charging device, wherein said controller executes the developer collecting mode depending on the amount of the current passing through said first auxiliary charging device.

* * * * *